US006964501B2

(12) United States Patent
Ryan

(10) Patent No.: US 6,964,501 B2
(45) Date of Patent: Nov. 15, 2005

(54) PELTIER-COOLED LED LIGHTING ASSEMBLY

(75) Inventor: John T. Ryan, Riverdale, NY (US)

(73) Assignee: Altman Stage Lighting Co., Ltd., Yonkers, NY (US)

( * ) Notice: Subject to any disclaimer, the term of this patent is extended or adjusted under 35 U.S.C. 154(b) by 38 days.

(21) Appl. No.: 10/328,634

(22) Filed: Dec. 24, 2002

(65) Prior Publication Data

US 2004/0120156 A1 Jun. 24, 2004

(51) Int. Cl.[7] ..... F21V 29/00
(52) U.S. Cl. ..... 362/294; 362/373; 362/800
(58) Field of Search ..... 362/96, 234, 235, 362/240, 294, 373, 800

(56) References Cited

U.S. PATENT DOCUMENTS

| | | | | |
|---|---|---|---|---|
| 4,685,081 A | | 8/1987 | Richman | 365/1 |
| 4,729,076 A | * | 3/1988 | Masami et al. | 362/235 |
| 4,935,864 A | | 6/1990 | Schmidt et al. | 363/141 |
| 5,343,360 A | | 8/1994 | Sanwo | 361/707 |
| 5,376,184 A | | 12/1994 | Aspden | 136/203 |
| 5,637,921 A | | 6/1997 | Burward-Hoy | 257/712 |
| 5,714,791 A | | 2/1998 | Chi et al. | 257/467 |
| 5,724,818 A | | 3/1998 | Iwata et al. | 62/3.7 |
| 5,785,418 A | * | 7/1998 | Hochstein | 362/373 |
| 5,918,469 A | | 7/1999 | Cardella | 62/3.7 |
| 5,921,087 A | | 7/1999 | Bhatia et al. | 62/3.2 |
| 5,924,290 A | | 7/1999 | Yoshino | 62/3.7 |
| 5,966,938 A | | 10/1999 | Nagakubo et al. | 62/3.2 |
| 6,012,291 A | | 1/2000 | Ema | 62/3.7 |
| 6,094,919 A | | 8/2000 | Bhatia | 62/3.7 |
| 6,161,910 A | * | 12/2000 | Reisenauer et al. | 362/800 |
| 6,211,626 B1 | | 4/2001 | Lys et al. | 315/291 |
| 6,230,497 B1 | | 5/2001 | Morris et al. | 62/3.7 |
| 6,252,154 B1 | | 6/2001 | Kamada et al. | 136/201 |
| 6,347,521 B1 | | 2/2002 | Kadotani et al. | 62/3.7 |
| 6,832,849 B2 | * | 12/2004 | Yoneda et al. | 362/800 |
| 2002/0134419 A1 | | 9/2002 | Macris | 136/204 |

FOREIGN PATENT DOCUMENTS

DE 765953 A1 12/1997

OTHER PUBLICATIONS

Lumileds® Application Brief AB12, Custom Luxeon Design Guide, pp. 1-22, p. 10 indicating relative light output relative to junction temperature, located at http://www.lumileds.com/pdfs/AB12.PDF.

* cited by examiner

*Primary Examiner*—Y. My Quach-Lee
(74) *Attorney, Agent, or Firm*—Myron Greenspan, Esq.; Lackenbach Siegel LLP

(57) ABSTRACT

A high-powered lighting assembly includes an easily sealed continuous thermal barrier and a solid-state actively controlled closed-loop refrigeration system to maximize operational efficiencies and increase unit life. The thermal barrier prevents thermal back-flow from a heat sink plate or a housing to a lighting array while insulating a control module and a thermal sensor with improved sealing geometry. The refrigeration system is optimally positioned to controllably pump heat from the lighting array to the heat sink plate.

18 Claims, 5 Drawing Sheets

PELTIER-COOLED LED LIGHTING ASSEMBLY

BACKGROUND OF THE INVENTION

1. Field of the Invention

The present invention relates to a high-powered lighting assembly utilizing a solid-state thermoelectric cooling system for primary use in theatrical or architectural lighting fixtures. More specifically, the present invention relates to a lighting assembly having a continuous sealable thermal barrier and an active closed-loop refrigeration system employing a Peltier-effect thermo-electric module(s) (hereinafter TEM(s)).

2. Description of the Related Art

With the emergence of increasingly higher-powered Light Emitting Diodes (LED(s)) in lighting arrays, and their use in theatrical and architectural illumination applications, there has been a corresponding increase in heat generation concerns.

Specifically, as higher power LED(s) are used, and as higher concentrations of LED(s) are used, the heat generated detrimentally affects unit life span, and reduces unit operational efficiency.

As both high power LED(s) and high concentrations of LED(s) are frequently used in architectural and theatrical lighting fixtures, and since architectural and theatrical end users are particularly sensitive to unit degradation, there has been a growing need to supply high quality LED displays which do not degrade in continual use.

Prior techniques of cooling LEDs in architectural and theatrical lighting fixtures involved mounting the LED(s) in a manner which thermally connected the LED(s) directly to some form of heat spreading plate, which was then mounted in contact with the housing of the lighting assembly itself. Thereafter, the lighting housing operated to dissipate the heat into the surrounding ambient atmosphere at a rate dependant upon the ambient atmospheric conditions.

In high use and in demanding situations, the thermal transfer from the LED(s), through the thermally connected heat spreading plate to the housing is insufficient to maintain a desirable LED temperature. Common cures to undesirably thermal buildup thereafter employ the use of fans, cooling fins, spacing assemblies, etc. to reduce housing temperature. Unfortunately, thermal back-flow may occur as a housing is heated by the ambient atmosphere beyond an optimal point which allows thermal conduction back to the heat spreading plate. In such situations, rapid LED degradation occurs and unit efficiency drops.

The above techniques for thermal removal have the common disadvantage of using direct passive conduction and convection heat transfer from the LED(s) to the heat sink or heat spreading plate and thereafter to the housing. The passive nature of these techniques limits the cooled temperature of the LED(s) to at or near an ambient atmospheric temperature. Since the units are often in close conjunction or are retained in decorative housings, passive heat transfer and thermal back-flow rapidly reduce cooling efficiency.

The Peltier effect is well known by those skilled in the related arts and provides an active solid-state thermoelectric cooling function from a cool side to a hot side. The cool side is commonly placed against a surface or substrate which requires cooling. For example, the back surface of an LED assembly. The hot side is commonly placed against a surface or substrate which absorbs the transferred thermal energy and transfers it through conduction to a heat spreading plate.

The Peltier effect is one of several well known thermo-electric effects. Others are the Seebeck effect, the Thompson effect, and the Nernst-Ettinghausen effect. Through the utilization of these thermo-electric effects, thermal transfer from a cool side to a hot side can be controlled by controlling a current supplied to the thermo-electric effect.

Unfortunately, conventional constructions substantially negate the optimal use of an active cooling device by directly or indirectly connecting an LED or light array to a housing or heat spreading plate in a manner which allows thermal back flow to the lighting array through either thermal conduction or convection mechanisms.

Conventional lighting assembly constructions also fail to provide an effective control loop for an active cooling device through non-optimal location of thermal sensors, lack of thermal sensors, and ineffective positioning for the cooling device itself resulting in non-uniform cooling.

OBJECTS AND SUMMARY OF THE INVENTION

An object of the present invention is to provide a high-powered lighting assembly utilizing a Peltier-type solid-state thermo-electric cooling system.

Another object of the present invention is to provide an active cooling system for a lighting display which overcomes the problems noted above and prevents thermal back flow to the lighting display through either one of a conductive or a convective pathway.

Another object of the present invention is to provide a high-powered lighting assembly which is compact and is easily placed within multi-sized housings.

Another object of the present invention is to provide a high-powered lighting assembly which is easily assembled and provides adequate sealing surface area to enable a long-lived sealed assembly through multiple thermal cycles.

Another object of the present invention is to provide a high-powered lighting assembly which includes an electronic control module which maintains an optimal temperature relative to at least one of a heat sink plate temperature, a housing temperature, and an ambient atmosphere temperature.

Another object of the present invention is to provide a high-powered lighting assembly which allows easy sealing of a cover over the light-emitting array and thermally isolates the cover from the housing.

Another object of the present invention is to provide a high-powered lighting assembly which allows unidirectional thermal transfer from a light-emitting array to a heat sink plate and the housing.

Another object of the present invention is to provide a high-powered lighting assembly which maintains a desired temperature for a control module and a thermal sensor, thereby limiting unit degradation and false thermal readings.

The present invention relates to a high-powered lighting assembly having an easily sealed continuous thermal barrier and a solid-state actively controlled closed-loop refrigeration system. The thermal barrier prevents thermal back-flow from a heat sink plate or a housing to a lighting array while insulating a control module and a thermal sensor with improved sealing geometry. The refrigeration system is optimally positioned to controllably pump heat from the lighting array to the heat sink plate.

According to an embodiment of the present invention there is provided a high-powered lighting assembly, comprising: a heat sink plate in thermal contact with a housing, a light-emitting array on a thermally conductive printed circuit board having at least a metal layer opposite the array, means for sensing a temperature of the metal layer, means for cooling and transferring thermal energy from at least a first portion of the metal layer to the heat sink plate, means for controlling the cooling means and maintaining the temperature at a predetermined temperature during an operation of the assembly, and an insulation layer thermally isolating the array, the metal layer, the sensing means, and the control means from each of the housing and the heat sink plate, whereby the insulating layer prevents at least one of a convective and a conductive thermal back flow from the housing and the heat sink plate.

According to another embodiment of the present invention there is provided a high-powered lighting assembly, wherein: the cooling means includes at least one thermoelectric module having a cool side and a hot side during the operation, the cool side in sealed thermal contact with the metal layer, the hot side in sealed thermal contact with the heat sink plate, and the insulation layer bounding the thermoelectric module, whereby the insulation layer provides unidirectional thermal transfer to the heat sink plate through the at least one thermo-electric module.

According to another embodiment of the present invention there is provided a high-powered lighting assembly, further comprising: a plurality of Light Emitting Diodes in the array, and a dielectric layer on a front face of the metal layer adjacent the array.

According to another embodiment of the present invention there is provided a high-powered lighting assembly, wherein: the sensor means is on a back surface of the metal layer opposite the array, the control means includes at least one encapsulated electronics module, the electronics module is on the back surface of the metal layer proximate the sensor means, and the insulation layer thermally isolates both the sensor means and the electronics module from the heat sink plate and the housing, whereby the insulation layer maintains the sensor means and the electronics module at the predetermined temperature during the operation.

According to another embodiment of the present invention there is provided a high-powered lighting assembly, further comprising: at least a cover bounding a display side of the circuit board, the cover in sealing contact with the display side of the circuit board, the cover in sealing contact with an inner surface of a rim on the insulation layer, and an outer surface of the rim in sealing contact with the housing, whereby the insulation layer prevents conductive thermal transfer from the housing to the cover while the cover prohibits condensation on the array during the operation.

According to another embodiment of the present invention there is provided a high-powered lighting assembly, wherein: the cover includes at least one of a translucent, transparent, and optically refractive surface, the cover is constructed from one of a plastic and a ceramic, and a space defined between the cover and the display side of the circuit board contains one of an operably desirable gas, an operably desirable fluid, and an operably desirable gel.

According to another embodiment of the present invention there is provided a high-powered lighting assembly, wherein: the cooling means includes at least two thermoelectric modules, and the thermoelectric modules symmetrically positioned relative to the sensor means, whereby during the operation the metal layer receives symmetrical cooling and relative to the sensor means and an accuracy of the sensor means and the control means is improved.

According to another embodiment of the present invention there is provided a high-powered lighting assembly, wherein: the cooling means includes at least four thermoelectric modules, and the thermoelectric modules quadratically positioned relative to the sensor means, whereby during the operation the metal layer receives symmetrical cooling and relative to the sensor means and an accuracy of the sensor means and the control means is improved.

According to another embodiment of the present invention there is provided a high-powered lighting assembly, further comprising: means for dissipating heat from the housing during the operation, and the means for dissipating heat from the housing According to another embodiment of the present invention there is provided a high-powered lighting assembly, further comprising means for dissipating heat from the heat sink plate during the operation.

According to another embodiment of the present invention there is provided a high-powered lighting assembly, wherein: the heat sink plate defines a central opening, and the insulating layer extends within the central opening, whereby a thickness of the insulating layer thermally isolating the electronics module from the heat sink plate is uniform.

According to another embodiment of the present invention there is provided a high-powered lighting assembly, comprising: a heat sink plate in thermal contact with a housing, a light-emitting array on a thermally conductive printed circuit board having least a metal layer opposite the array, a thermal sensor unit for detecting a temperature of the metal layer, a thermo-electric cooling unit thermally joining the metal layer opposite the array and the heat sink plate, a control unit for controlling the cooling unit and maintaining the temperature at a predetermined temperature during an operation of the assembly, and an insulation layer sealingly and thermally isolating the array, the metal layer, the sensor unit, and the control unit from each of the housing and the heat sink plate, thereby preventing at least one of a convective and a conductive thermal back flow from both the housing and the heat sink plate.

According to another embodiment of the present invention there is provided a high-powered lighting assembly, wherein: the cooling unit includes at least one thermoelectric module having a cool side and a hot side during the operation of the assembly, the cool side in sealed thermal contact with the metal layer, the hot side in sealed thermal contact with the heat sink plate, and the insulation layer bounding the at least one thermo-electric module, whereby the insulation layer mandates unidirectional thermal transfer to the heat sink plate through the at least one thermoelectric module.

According to another embodiment of the present invention there is provided a high-powered lighting assembly, further comprising: a plurality of Light Emitting Diodes in the array, and a dielectric layer on a front face of the metal layer adjacent the array.

According to another embodiment of the present invention there is provided a high-powered lighting assembly, wherein: the sensor unit is on a back surface of the metal layer opposite the array, the control unit includes at least one encapsulated electronics module, the electronics module on the back surface of the metal layer proximate the sensor means, and the insulation layer thermally isolating both the sensor unit and the electronics module from the heat sink plate and the housing, whereby the insulation layer maintains the sensor means and the electronics module at the predetermined temperature during the operation.

According to another embodiment of the present invention there is provided a high-powered lighting assembly, further comprising: at least a cover bounding a display side of the circuit board, the cover in sealing contact with the display side of the circuit board, the cover in sealing contact with an inner surface of a rim on the insulation layer, and an outer surface of the rim in sealing contact with the housing, whereby the insulation layer prevents conductive thermal transfer from the housing to the cover and the cover prevents condensation on the array during the operation.

According to another embodiment of the present invention there is provided a high-powered lighting assembly, comprising: a heat sink plate in thermal contact with a housing, a light-emitting array, means for sensing a temperature of the array, means for cooling and transferring thermal energy from at least a first portion of the array to the heat sink plate, means for controlling the cooling means and maintaining the temperature at a predetermined temperature during an operation of the assembly, and means for insulating and thermally isolating the array, the metal layer, the sensor means, and the control means from each of the housing and the heat sink plate, and preventing at least one of a convective and a conductive thermal back flow from both the housing and the heat sink plate to the metal layer.

According to another embodiment of the present invention, there is provide a high-powered lighting assembly, comprising: a heat sink plate in thermal contact with a housing, a light-emitting array, control means for controllably maintaining a temperature of the array at a predetermined temperature during an operation of the assembly, and insulation means for thermally isolating the array and the control means from the heat sink plate and the housing during the operation by preventing one of a convective and a conductive thermal back flow from one of the housing and the heat sink plate to the array.

The above, and other objects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1:
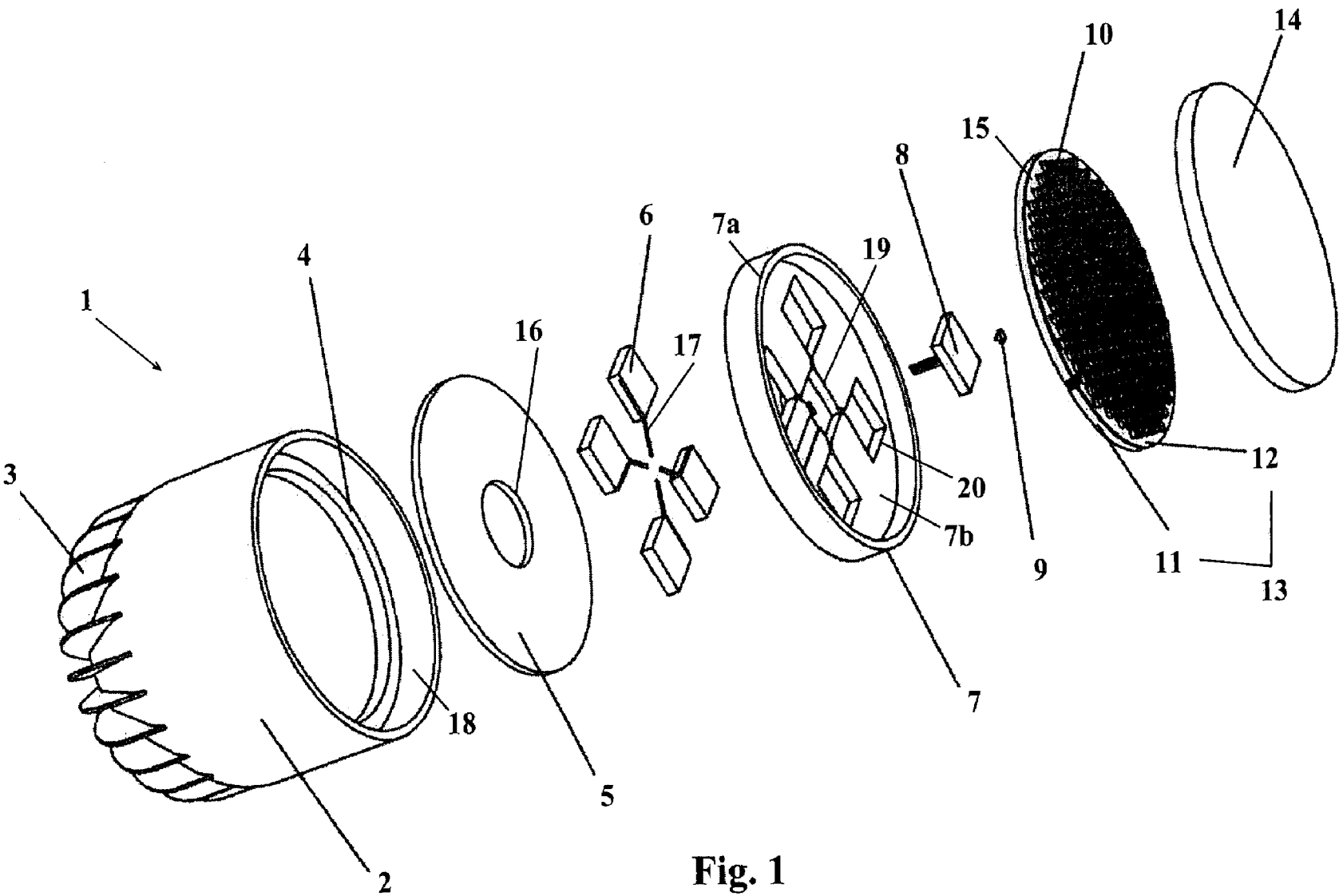
FIG. 1 is an exploded view of a Peltier-Cooled LED lighting assembly according to one embodiment of the present invention.

Referring now to FIG. 1, a lighting assembly 1 includes a cylindrically shaped housing 2 having a closed bottom end and an open top end. A plurality of fins 3 extend radially from the bottom end of housing 2 and aid in convective thermal transfer, as will be explained. A ring shaped mounting surface 4 extends continuously around an inner surface 18 at the top end of housing 2.

Housing 2 may be formed from any material suitable for a desired application including plastics and metals such as aluminum and steel. Housing 2 may additionally include brackets, threaded holes, or connection surfaces useful in mounting lighting assembly 1 to an external structure (not shown). Alternative embodiments to the present invention envision additional structures on housing 2 for speedy removal of thermal energy, including vents, liquid cooling structures, forced air structures, and fans (all not shown).

During assembly, a heat sink plate 5 seals tightly to mounting surface 4 and provides a thermal conductive path between heat sink plate 5 and housing 2. Heat sink plate 5 is secured to housing 2 by conventional adhesive or mechanical fasteners. Thermal energy flows from heat sink plate 5 to housing 2 and is further dissipated by fins 3, forced air flow, liquid or other thermal transfer mechanisms. Alternative embodiments of the present invention envision additional structures for removing thermal energy from heat sink plate 5 including forced air flow, gas, and liquid cooling features.

An light-emitting array 10 includes a series of LED(s) mounted on a top surface of a thermally-conductive printed circuit board 13 (hereinafter TCPCB). Light-emitting array 10 of LED(s) may include white or any color or combination of LED(s) desirable to an end user. Light-emitting array 10 is alternatively powered by a DC current, pulsed current, AC current, rectified AC current, phase shifted current, or in any manner which would be commonly known in the art of powering light-emitting LED displays.

TCPCB 13 includes an electrical circuit conductor layer 15 on a top surface of a thin thermally conductive dielectric layer 12. A metal substrate layer 11 backs dielectric layer 12. Metal substrate layer 11 may be from any suitable metal which is compatible with dielectric layer 12. TCPCB(s) 13 of a type suitable for the present application are available from The Bergquest Co. of Cannon Falls, Minn.

During operation of light-emitting array 10, heat buildup flows from conductor layer 15, through dielectric layer 12 to metal substrate layer by direct thermal conduction.

Figure 2:
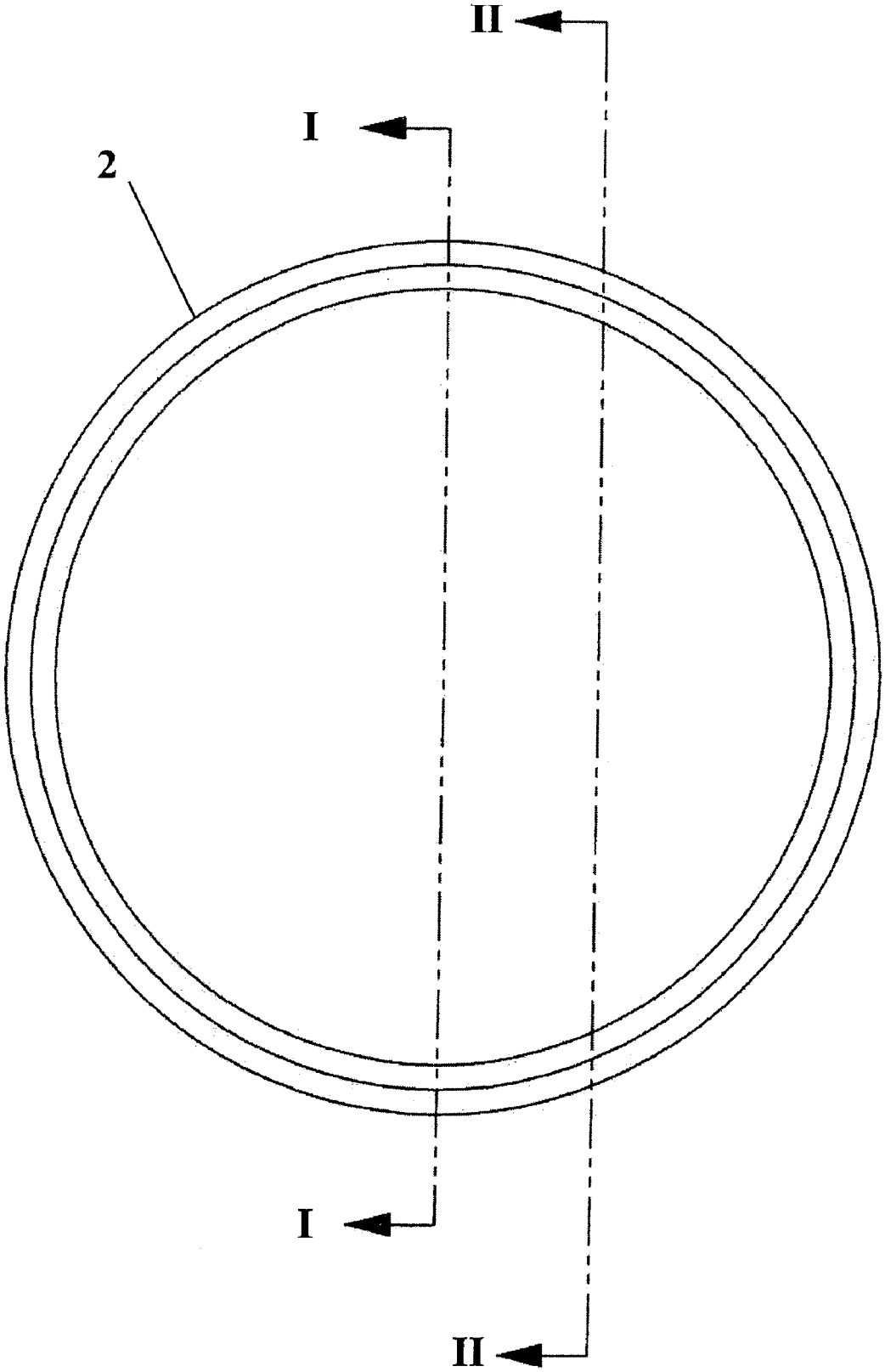
FIG. 2 is an end view of a housing as shown in FIG. 1.
Figure 3:
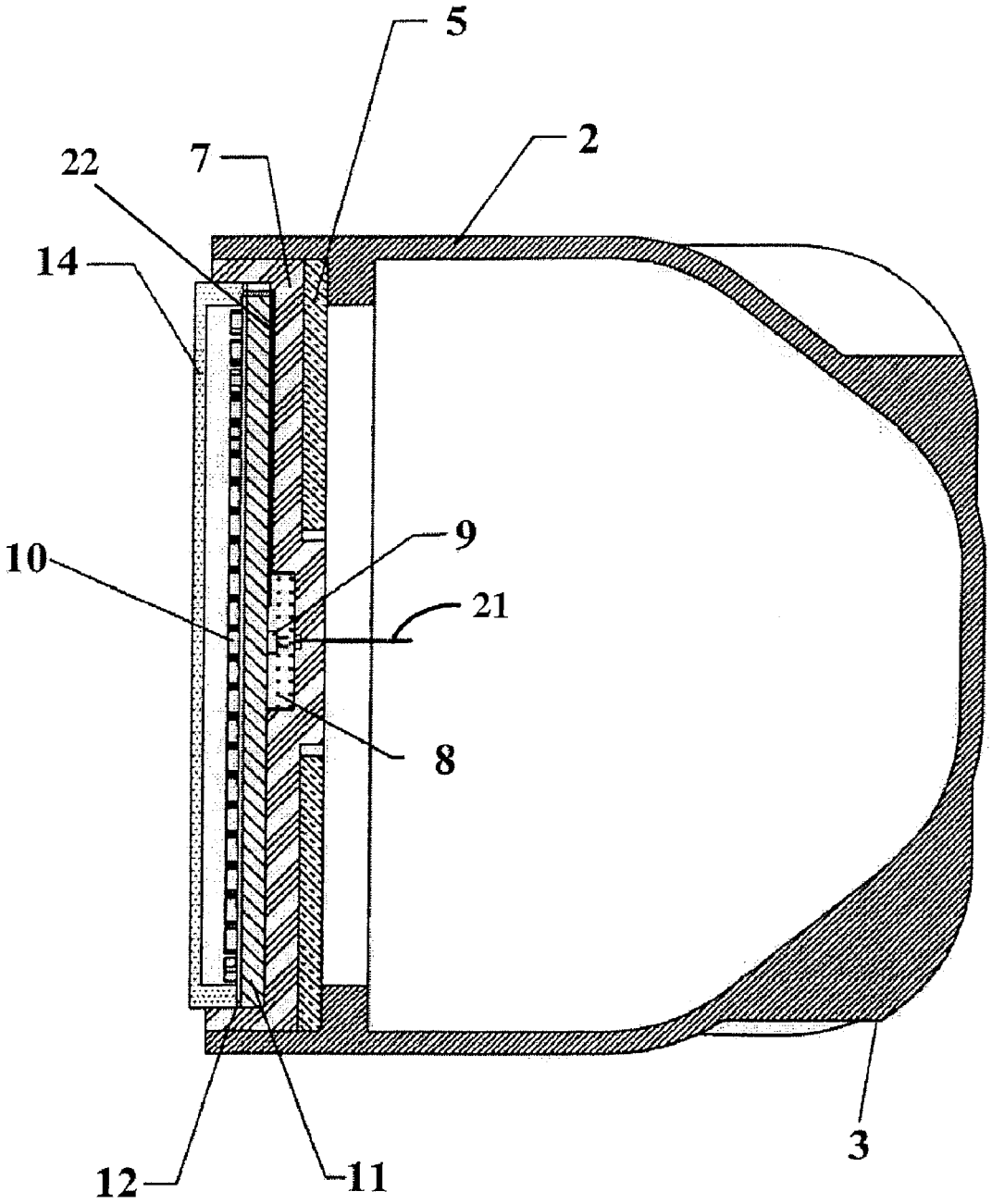
FIG. 3 is a sectional view along line I—I of FIG. 2.
Figure 4:
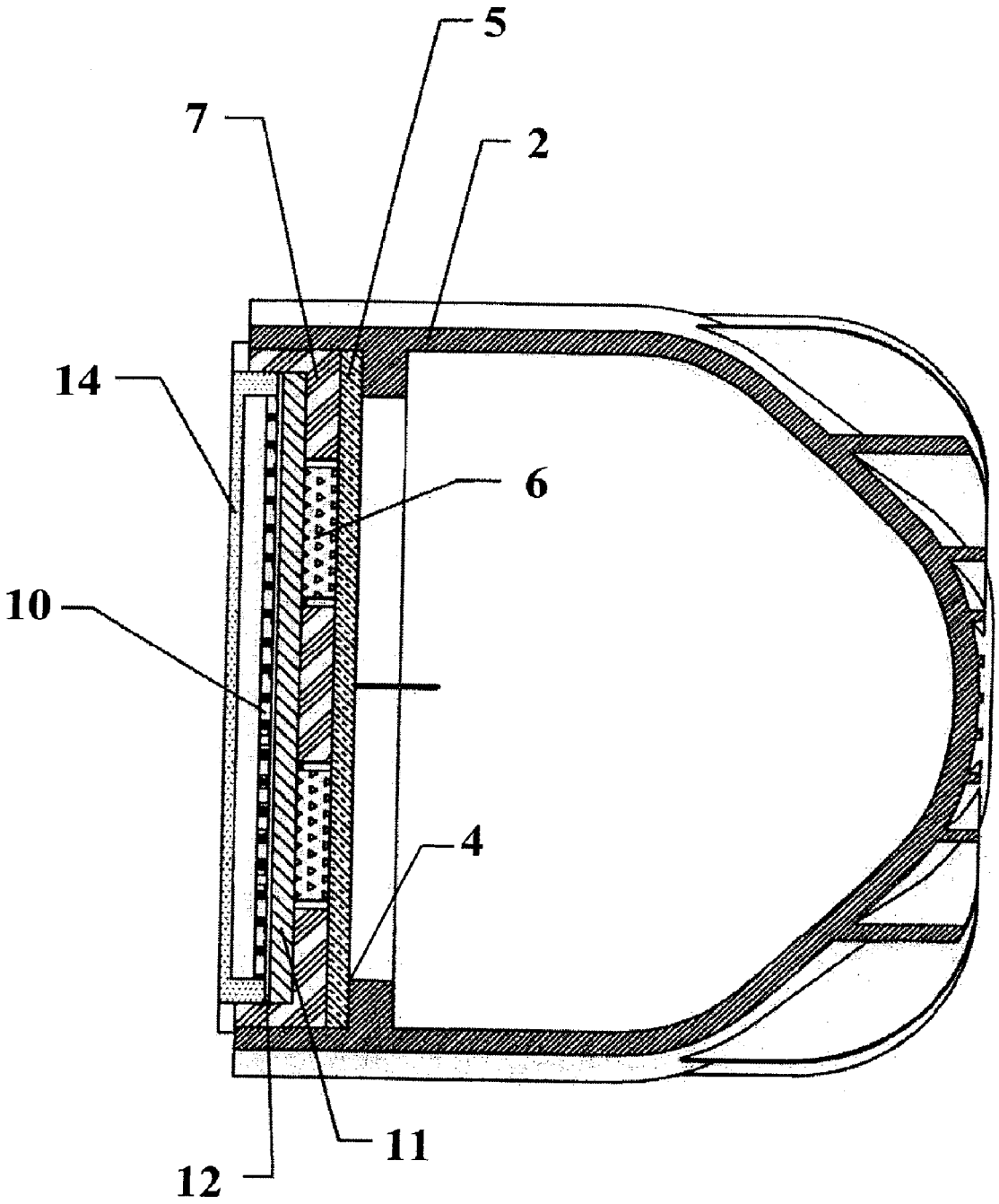
FIG. 4 is a sectional view along line II—II of FIG. 2.

Additionally referring now to FIGS. 2, 3, and 4, at least one solid-state thermo-electric module 6 (hereinafter TEM (s)) mounts directly to the back side of metal substrate layer 11, opposite array 10. A 'cold' side of TEM 6 thermally contacts a back surface of metal substrate 11, as shown. A thermally conductive adhesive or grease ensures thermal connection between the 'cold' side of TEM 6 and the back surface of metal substrate 11. A 'hot' side of TEM 6 thermally connects with heat sink plate 5, as shown. A thermally conductive adhesive or grease ensures thermal connection between the 'cold' side of TEM 6 and the back surface of metal substrate 11. Connections 17 (a positive and negative electrical lead, not shown) join each TEM 6 to an electronic control module, as will be explained.

TEM(s) 6 prevent metal substrate 11 from directly contacting, and thermally conducting to heat sink plate 5. In the present embodiment four TEM(s) 6 are arrayed, but alternative positioning is envisioned by the present disclosure dependant upon the cooling needs of the light-emitting array 10. Each embodiment envisioned positions TEM(s) 6 symmetrically on metal substrate 11 to uniformly remove heat.

During operation a DC electrical voltage is applied to respective TEM(s) 6 via electrical connections 17, and causes thermal energy to be actively transferred or "pumped" from the cold side surface to the hot side surface of TEM(s) 6 by virtue of the well known Peltier effect. The thermal transfer and the rate of transfer is proportional to the DC current applied to TEM(s) 6, and serves to cool TCPCB 13 and electrical connections 17.

Peltier-effect solid state thermo-electric modules (TEM (s)) or similarly operating thermoelectric coolers (TEC(s)), of a type suitable for the present invention, are available from Advanced Thermoelectric Co. of Nashua, N.H.

An insulation barrier 7 surrounds array 10 and TCPCB 13 and thermally isolates both array 10 and TCPCB 13 from housing 2 and heat sink plate 5. Insulation barrier 7 has a cylindrical shape a base 7*b* and a rim 7*a*. During assembly, rim 7*a* contacts inner surface 18 of housing 2 adjacent mounting surface 4, and base 7*b* contacts the upper surface of heat sink plate 5. In this manner, the present invention prevents direct thermal conduction between array 10 and TCPCB 13 and housing 2 or heat sink plate 5.

A passage 20 in insulation barrier 7 tightly conforms to an outline of each TEM 6 while allowing the cold surface of each TEM 6 to thermally contact TCPCB 13, and the hot surface of each TEM 6 to thermally contact heat sink plate 5. Holes, channels, or passages, (all not shown) within insulation barrier 7 allow sealing passage for electrical connectors 17 from TEM(s) 6 to electronic control module 8.

Insulation barrier 7 forms a mechanically secure and gas tight seal between inner surface 18 and heat sink plate 5 and prevents convection and conduction heating of TCPCB 13 by either heat sink plate 5 or housing 2. Insulation barrier 7 is formed from any desirably thermally resistive material, including ceramics or a plastics, and may additionally include internal air spaces to improve thermal efficiency.

A cavity 19 in insulation barrier 7 closely houses electronic control module 8 and prevents thermal transfer between electronic control module 8 and heat sink plate 5.

A thermal sensor 9 contacts a rear surface of metal layer 11 and senses a temperature directly related to an operational temperature of light-emitting array 10. Cavity 19 in insulation barrier 7 thermally isolates thermal sensor 9 from heat sink plate 5 and prevents false thermal readings or thermal 'bleed back' from heat sink plate 5 to thermal sensor 9. In this manner one skilled in the art should understand that thermal sensor 9 is optimally positioned to read a true operational temperature from the metal substrate 11 immediately adjacent array 10.

Thermal sensor 9 may be one or more electronic heat sensors and may include a thermocouple, thermistor, infrared photo-diode, or other device. This type of electrical heat sensor is common in the art and is readily available from multiple sources.

Encapsulated electronics module 8 surrounds thermal sensor 9 and is in electrical connection with thermal sensor 9 and TEM(s) 6. An electronic pathway, in the form of electrical conductor(s) operably joins the electronic control module with the light-emitting array 10. Conductive means, in the form of a connective attachment 21 operably electrically connects the electronic control module 8 and the light-emitted array 10 for controlling the LED array. Any other interconnection means between the electronic control module 8 and the light-emitting array 10, suitable for any given configuration, may be used. Similarly, the specific or means for connecting the electronic control module 8 to a central bus and/or a source of electrical power is not critical. Encapsulated electronics module may alternatively or additionally electrical connect with a light-array current sensing circuit (not shown).

An opening 16, proximate a center of heat sink plate 5 allows insulation barrier 7 to thermally isolate electronics module 8 from both heat sink plate 5 and TEM(s) 6 by providing uniform insulation depths. Uniform thermal isolation of electronics module 8 minimizes false readings, prevents thermal degradation, increases life span, and increases operational efficiency of array 10.

Electronics module 8 fits snugly within cavity 19 in the center of insulating barrier 7 and is secured in cavity 19 by conventional means including adhesive and mechanical fasteners. Nesting electronics module 8 within thermally isolated cavity 19 allows easy sealing of electronics module 8 and thermal sensor 9 to metal substrate 11 during assembly Electronics module 8 operates with to maintain a predetermined temperature range for light emitting array 10 and conserve a total amount of electrical power consumed by lighting assembly 1. Electronics module 8 achieves these goals by containing electronic circuitry sufficient to monitoring the temperature of light-emitting array 10 via temperature sensor 9, and alternatively or additionally monitoring an electrical current supplied to light-emitting array 10 through an electronic circuit (not shown).

Electronics module 8 may be encapsulated within a thermally conductive and water resistant material to further aid in maintaining the electronic circuitry within electronics module 8 in a low humidity and high heat dissipation environment.

According to the present design, the power supplied to electronics module 8, TEM(s) 6, and light-emitting array 10 during operation is supplied individually, from a local common power supply, or in any manner desired by the manufacturer.

In alternative embodiments, electronics module 8 may receive electrical power and control signals or control data from either an inside or an outside of housing 2 through electrical conductors, AC power supplies, DC power supplies, pulsed power supplies, batteries, or other methods including radio, infrared, photocell, and acoustic methods effective to provide a regulated electrical current to light-emitting array 10.

A thermally insulating and optically transparent cover 14 covers light-emitting array 10 and is sealed to outer rim 7*a* of insulation barrier 7. Insulation barrier 7 prevents transparent cover 14 from contacting housing 2 and consequently prevents transmission of thermal energy to array 10. Since transparent cover 14 is sealed to outer rim 7*a* of insulation barrier 7, which is in turn sealed within housing 2, it is easy to maintain low atmospheric humidity adjacent light-emitting array 10 and prevent condensation when light emitting array 10 is cooled below an ambient dew-point. The area bounded by transparent cover 14 and light-emitting array 10 may be filled with a dry gas, gel, or fluid to further aid operational efficiency. Transparent cover 14 may include optically reflecting or refracting surfaces according to a manufacturers needs.

Figure 6:
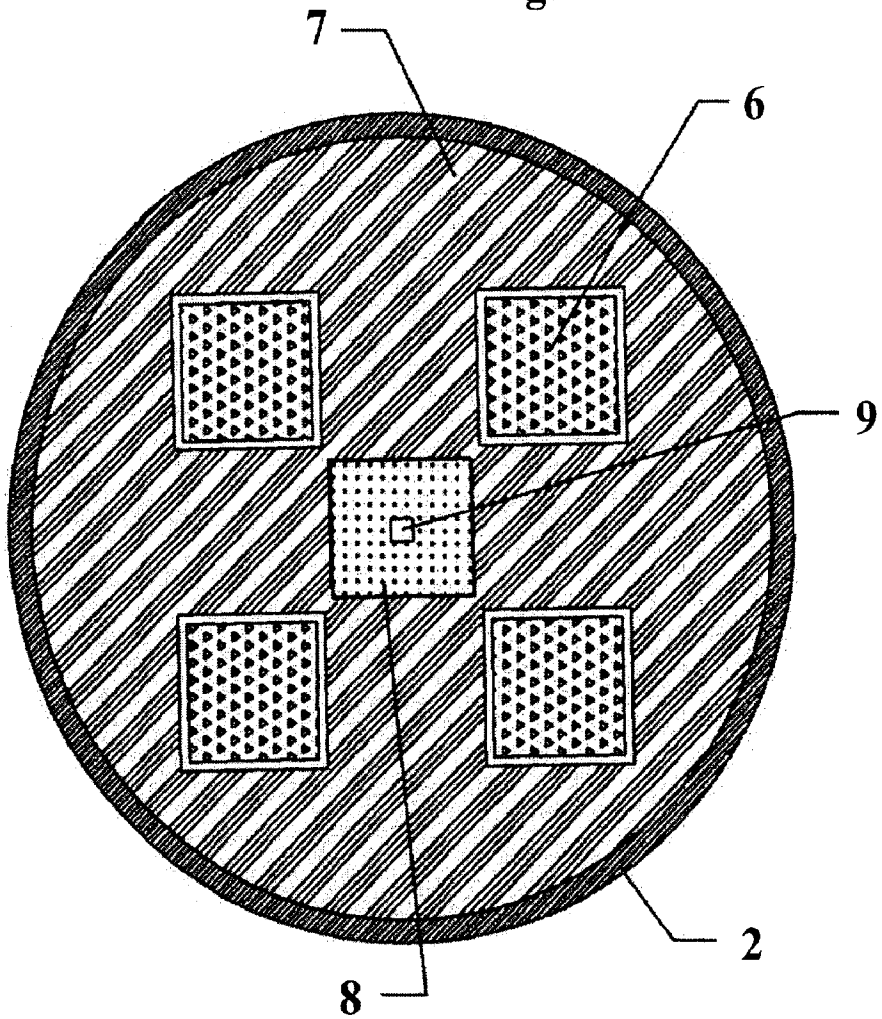
FIG. 6 is a sectional view along line III—III of FIG. 5.
Figure 5:
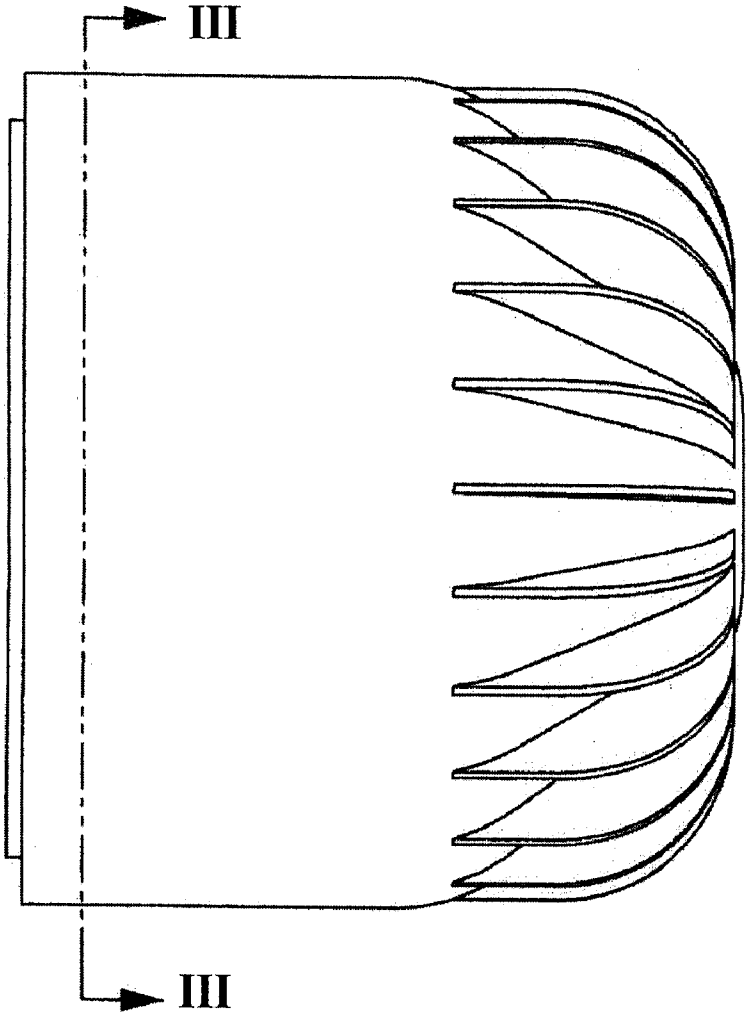
FIG. 5 is side view of a housing as shown in FIG. 1.

Referring now to FIGS. 5 and 6, TEM(s) 6 are quadratically positioned relative to centered electronics module 8 and thermal sensor 9. Connections 17 operably join each TEM 6 to electronics module 8 and allow for precise thermal control. During operation, since the hot side surface of each TEM 6 is in sealed thermal contact with heat sink plate 5, when DC electrical voltage is applied, heat is unidirectionally transferred proportionally to heat sink plate 5. Consequently, heat sink plate 5 becomes hotter and TCPCB 13, connections 17, and array 10 become colder.

Since insulation barrier 7 closely bounds TEM(s) 6 convection transfer around the outer sides of TEM(s) 6 is prevented. In this manner, insulation barrier 7 forces all thermal transfer between metal substrate 11 and heat sink plate 5 to occur through TEM(s) 6.

During an assembly of lighting assembly 1, heat sink plate 5 is positioned and sealed to housing 2 on mounting surface 4. Next, TEM(s) 6, are sealingly positioned on heat sink plate 5 and insulation barrier 7 is positioned in housing 2 while rim 7*a* is sealed to inner surface 18. Passages 20 in insulation barrier 7 snugly surround TEM(s) 6. Electronics module 8 is positioned in cavity 19 and joined to thermal sensor 9 and respective TEM(s) 6. TCPCB 13 is inserted in insulation barrier 7 attached and sealed to insulating barrier 7 by means of appropriate adhesives or mechanical fasteners. Further, TCPCB 13 may be hermetically sealed to insulating barrier 7 to minimize build-up of undesired compound on either element. Cover 14 is sealed to both dielectric layer 12 and rim 7*a* using appropriate adhesives or mechanical fasteners.

The present invention provides an active closed-loop solid state refrigeration system, utilizing Peltier effect Thermo-Electric Module(s), which act as electronic "heat pumps" and cool lighting assembly 1 well below ambient air temperature, and possibly even the ambient dew point. The ability of the present invention to operate at a lower operational temperatures provides a significant increase in light output for a given amount of electrical current supplied to the LED(s). As an additional benefit, the present design also cools the local electronic circuitry within the assembly and prevents over heating. The present designs further provides simple assembly geometry which enables sealing the LED (s), insulation barrier 7, transparent cover 14, and electronic circuitry within housing 2 and hence prevents condensation damage.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the spirit and scope of this invention as defined in the following claims.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A high-powered lighting assembly, comprising:

a heat sink plate in thermal contact with a housing;

a light-emitting array on a thermally conductive printed circuit board having at least a metal layer opposite said array;

means for sensing a temperature of said metal layer;

means for cooling and transferring thermal energy from at least a first portion of said metal layer to said heat sink plate;

means for controlling said cooling means and maintaining said temperature at a predetermined temperature during an operation of said assembly; and an insulation layer thermally isolating said array, said metal layer, said sensing means, and said control means from each of said housing and said heat sink plate, whereby said insulating layer prevents at least one of a convective and a conductive thermal back flow from said housing and said heat sink plate.

2. A high-powered lighting assembly, according to claim 1, wherein:

said cooling means includes at least one thermo-electric module having a cool side and a hot side during said operation;

said cool side in sealed thermal contact with said metal layer;

said hot side in sealed thermal contact with said heat sink plate; and said insulation layer bounding said thermo-electric module, whereby said insulation layer provides unidirectional thermal transfer to said heat sink plate through said at least one thermo-electric module.

3. A high-powered lighting assembly, according to claim 2, further comprising:

a plurality of Light Emitting Diodes in said array; and a dielectric layer on a front face of said metal layer adjacent said array.

4. A high-powered lighting assembly, according to claim 2, wherein:

said sensor means is on a back surface of said metal layer opposite said array;

said control means includes at least one encapsulated electronics module;

said electronics module is on said back surface of said metal layer proximate said sensor means; and said insulation layer thermally isolates both said sensor means and said electronics module from said heat sink plate and said housing, whereby said insulation layer maintains said sensor means and said electronics module at said predetermined temperature during said operation.

5. A high-powered lighting assembly, according to claim 4, wherein:

said heat sink plate defines a central opening; and said insulating layer extends within said central opening, whereby a thickness of said insulating layer thermally isolating said electronics module from said heat sink plate is uniform.

6. A high-powered lighting assembly, according to claim 2, wherein:

said cooling means includes at least two thermo-electric modules; and said thermo-electric modules symmetrically positioned relative to said sensor means, whereby during said operation said metal layer receives symmetrical cooling and relative to said sensor means an accuracy of said sensor means and said control means is improved.

7. A high-powered lighting assembly, according to claim 6, wherein:

said cooling means includes at least four thermo-electric modules; and said thermo-electric modules quadratically positioned relative to said sensor means, whereby during said operation said metal layer receives symmetrical cooling and relative to said sensor means an accuracy of said sensor means and said control means is improved.

8. A high-powered lighting assembly, according to claim 2, further comprising:

means for dissipating heat from said housing during said operation; and said means for dissipating heat from said housing includes at least a plurality of heat radiating fins on an outer surface of said housing.

9. A high-powered lighting assembly, according to claim 8, further comprising means for dissipating heat from said heat sink plate during said operation.

10. A high-powered lighting assembly, according to claim 1, further comprising:

at least a cover bounding a display side of said circuit board;

said cover in sealing contact with said display side of said circuit board;

said cover in sealing contact with an inner surface of a rim on said insulation layer; and an outer surface of said rim in sealing contact with said housing, whereby said insulation layer prevents conductive thermal transfer from said housing to said cover and said cover minimizes condensation on said array during said operation.

11. A high-powered lighting assembly, according to claim 10, wherein:

said cover includes at least one of a translucent, transparent, and optically refractive surface;

said cover is constructed from at least one of a plastic and a ceramic; and a space defined between said cover and said display side of said circuit board contains an operably desirable gas.

12. An high-powered lighting assembly, comprising:

a heat sink plate in thermal contact with a housing;

a light-emitting array on a thermally conductive printed circuit board having at least a metal layer opposite said array;

a thermal sensor unit for detecting a temperature of said metal layer;

a thermo-electric cooling unit thermally joining said metal layer opposite said array and said heat sink plate;

a control unit for controlling said cooling unit and maintaining said temperature at a predetermined temperature during an operation of said assembly; and an insulation layer sealingly and thermally isolating said array, said metal layer, said sensor unit, and said control unit from each of said housing and said heat sink plate, thereby preventing at least one of a convective and a conductive thermal back flow from both said housing and said heat sink plate.

13. A high-powered lighting assembly, according to claim 12, wherein:

said cooling unit includes at least one thermo-electric module having a cool side and a hot side during said operation of said assembly;

said cool side in sealed thermal contact with said metal layer;

said hot side in sealed thermal contact with said heat sink plate; and said insulation layer bounding said at least one thermo-electric module, whereby said insulation layer mandates unidirectional thermal transfer to said heat sink plate through said at least one thermo-electric module.

14. A high-powered lighting assembly, according to claim 13, further comprising:

a plurality of Light Emitting Diodes in said array; and a dielectric layer on a front face of said metal layer adjacent said array.

15. A high-powered lighting assembly, according to claim 13, wherein:

said sensor unit is on a back surface of said metal layer opposite said array;

said control unit includes at least one encapsulated electronics module;

said electronics module on said back surface of said metal layer proximate said sensor means; and said insulation layer thermally isolating both said sensor unit and said electronics module from said heat sink plate and said housing, whereby said insulation layer maintains said sensor means and said electronics module at said predetermined temperature during said operation.

16. A high-powered lighting assembly, according to claim 12, further comprising:

at least a cover bounding a display side of said circuit board;

said cover in sealing contact with said display side of said circuit board;

said cover in sealing contact with an inner surface of a rim on said insulation layer; and an outer surface of said rim in sealing contact with said housing, whereby said insulation layer prevents conductive thermal transfer from said housing to said cover and said cover prevents condensation on said array during said operation.

17. A high-powered lighting assembly, comprising:

a heat sink plate in thermal contact with a housing;

a light-emitting array on a first member having at least a metal layer opposite said array;

means for sensing a temperature of said array;

means for cooling and transferring thermal energy from at least a first portion of said array to said heat sink plate;

means for controlling said cooling means and maintaining said temperature at a predetermined temperature during an operation of said assembly; and means for insulating and thermally isolating said array, said metal layer, said sensor means, and said control means from each of said housing and said heat sink plate, and preventing at least one of a convective and a conductive thermal back flow from one of said housing and said heat sink plate to said metal layer.

18. A high-powered lighting assembly, comprising:

a heat sink plate in thermal contact with a housing;

a light-emitting array;

control means for controllably maintaining a temperature of said array at a predetermined temperature during an operation of said assembly; and insulation means for thermally isolating said array and said control means from said heat sink plate and said housing during said operation by preventing one of a convective and a conductive thermal back flow from one of said housing and said heat sink plate to said array.

* * * * *